US005652481A

United States Patent [19]

Johnson et al.

[11] Patent Number: 5,652,481

[45] Date of Patent: Jul. 29, 1997

[54] AUTOMATIC STATE TRANITION CONTROLLER FOR A FLUORESCENT LAMP

[75] Inventors: Samuel A. Johnson, Eagle; Dan E. Rothenbuhler, Meridian; Gerald G. Miller, Boise, all of Id.

[73] Assignee: Beacon Light Products, Inc., Meridian, Id.

[21] Appl. No.: 616,739

[22] Filed: Mar. 15, 1996

Related U.S. Application Data

[63] Continuation-in-part of Ser. No. 258,007, Jun. 10, 1994, Pat. No. 5,537,010, Ser. No. 404,880, Mar. 16, 1995, Pat. No. 5,504,398, and Ser. No. 406,183, Mar. 16, 1995.

[51] Int. Cl.[6] ..... G05F 1/00

[52] U.S. Cl. ..... 315/308; 315/307; 315/290; 315/289; 315/106; 315/159

[58] Field of Search ..... 315/307, 308, 315/289, 291, 290, 246, 247, 283, 243, 209 SC, 209 R, 200 R, 103, 105, 106, 159

[56] References Cited

U.S. PATENT DOCUMENTS

| | | | |
|---|---|---|---|
| Re. 35,220 | 4/1996 | Johnson | 315/208 |
| 3,851,209 | 11/1974 | Marakami et al. | 315/99 |
| 3,927,345 | 12/1975 | Licata | 315/DIG. 5 |
| 3,990,000 | 11/1976 | Digneffe | 315/24 |
| 4,107,579 | 8/1978 | Bodine, Jr. et al. | 315/205 |
| 4,649,323 | 3/1987 | Pearlman et al. | 315/307 |
| 4,673,844 | 6/1987 | Maytum et al. | 315/200 R |
| 4,733,138 | 3/1988 | Pearlman et al. | 315/307 |
| 4,870,340 | 9/1989 | Kral | 323/235 |
| 5,221,877 | 6/1993 | Falk | 315/291 |
| 5,264,761 | 11/1993 | Johnson | 315/291 |
| 5,504,398 | 4/1996 | Rothenbuhler | 315/209 R |
| 5,537,010 | 7/1996 | Johnson et al. | 315/289 |

FOREIGN PATENT DOCUMENTS

| | | |
|---|---|---|
| 46395 | 2/1982 | European Pat. Off. . |
| 197035 | 10/1986 | European Pat. Off. . |
| 471215 | 2/1992 | European Pat. Off. . |
| 0471331 | 2/1992 | European Pat. Off. . |
| 471332 | 2/1992 | European Pat. Off. . |
| 0496040 | 7/1992 | European Pat. Off. . |
| 2517211 | 10/1976 | Germany . |
| 9100552 | 5/1991 | Germany . |
| WOA9535646 | 12/1995 | WIPO . |

OTHER PUBLICATIONS

Startlight TN22 Preliminary Data Sheet, *SGS–Thompson Microelectronics*, Nov., 1991, pp. 1/5 – 5/5.

*Primary Examiner*—Robert Pascal
*Assistant Examiner*—Haissa Philogene
*Attorney, Agent, or Firm*—John R. Ley

[57] ABSTRACT

A control module and method controls the operation of a fluorescent lamp in a circuit in which the lamp is connected to a ballast and energized by alternating half-cycles of power supplied from an AC power source. The fluorescent lamp has cathodes and a medium which emits light energy when energized into a plasma. A controllable switch conducts half-cycles of AC current through the cathodes and commutates into a non-conductive condition. A sensor supplies sensing signals related to an electrical condition at the cathodes. A state transition controller controls the switch. The state transition controller establishes a power-up, warm-up, ignition and fire operational states and transitions between the states in response to the electrical condition sensed and the time duration of those conditions. The lamp lights more reliably, premature failure of the ballast and cathodes is prevented due to overheating, and the lamp is controlled effectively by input signals in the form of short power interruptions.

21 Claims, 4 Drawing Sheets

AUTOMATIC STATE TRANITION CONTROLLER FOR A FLUORESCENT LAMP

CROSS REFERENCE TO RELATED APPLICATIONS

This is a continuation-in-part of U.S. patent application Ser. No. 08/258,007 for "Voltage-comparator, solid-state, current switch starter for fluorescent lamp" filed Jun. 10, 1994 now U.S. Pat. No. 5,537,010; Ser. No. 08/404,880 for "Dimming Controller for a Fluorescent Lamp," filed Mar. 16, 1995 now U.S. Pat. No. 5,504,398; and Ser. No. 08/406,183 for "Method for Dimming a Fluorescent Lamp," filed Mar. 16, 1995.

The present invention may be used advantageously in conjunction with the inventions described in U.S. patent applications Ser. No. 08/531,037 for "Method of Regulating Lamp Current Through a Fluorescent Lamp by Pulse Energizing a Driving Supply", filed Sep. 19, 1995; Ser. No. 08/530,673 for "Preheating and Starting Circuit and Method for a Fluorescent Lamp," filed Sep. 19, 1995; and Ser. No. 08/530,563 for "Resonant Voltage-Multiplying, Current-Regulating and Ignition Circuit for a Fluorescent Lamp," filed Sep. 19, 1995.

The invention described in U.S. patent application Ser. No. 08/616,541 for "Dimming Control System and Method for a Fluorescent Lamp" filed concurrently herewith may be used in conjunction with and in complement to the present invention. Furthermore, certain aspects of the present invention may be advantageously accomplished by using the invention described in U.S. patent application Ser. No. 08/257,899 for a "High Temperature, High Holding Current Semiconductor Thyristor," filed Sep. 9, 1994.

All of these U.S. Patent Applications are assigned to the assignee hereof. The information contained in all of the above identified applications is incorporated herein by this reference.

This invention relates to fluorescent lamps and other similar types of discharge lamps. More particularly, this invention relates to a new and improved control module and control method for controlling the operation of a fluorescent lamp. A state transition controller of the control module and the control method establish a plurality of operational states and execute transitions between the operational states in response to timing conditions and electrical conditions that are sensed across the cathodes of the fluorescent lamp, among other things.

BACKGROUND OF THE INVENTION

There are many desirable operational features available from fluorescent lamps, in distinction to incandescent lamps. For example, fluorescent lamps typically use substantially less electrical power and produce equal or greater illumination from the same or less electrical power consumption.

One of the difficulties associated with fluorescent lamps is that they require exterior control equipment to provide reliable operation and to obtain a reasonable longevity of use. Ballasts are required to limit the current that flows in an arc between filament electrodes known as cathodes located at each end of the lamp. Starters control the voltage between the cathodes to generate a high voltage ignition pulse which ignites the medium between the cathodes into a conductive plasma. Once the medium is ignited, the lamp can remain lit by applying the typical power supply voltage between the cathodes to sustain the plasma.

The complexity of controlling the operation of the lamp can present difficult problems and contribute to the unreliable operation and the premature failure of the lamp. To start or ignite the lamp, the current and voltage applied to the cathodes are controlled to preheat the cathodes to a sufficient temperature before a high voltage ignition pulse is applied between the cathodes to ignite the medium into a conductive plasma. The current applied to preheat the cathodes causes a thermionic coating on the cathodes to emit a cloud of electrons. If the cathodes have not been sufficiently preheated before the high voltage ignition pulse is applied, the cloud of electrons will be insufficient to support the initial arc and the lamp will remain unlit despite the application of the high voltage starting pulse.

The thermionic coating on the cathodes is severely eroded when the high voltage ignition pulse is applied to insufficiently heated cathodes. After significant erosion, the thermionic coating becomes incapable of generating sufficient electrons for starting the lamp on a reliable basis. Thus, erosion of the thermionic cathode coating severely reduces the usable lifetime of the lamp. A major contributing factor to the excessive erosion of the lamp cathodes is repeated application of the high voltage ignition pulses during unsuccessful attempts to start the lamp when the cathodes have been insufficiently heated.

Proper operation of the lamp is further complicated by interruptions in the power supplied to the lamp. During ignition of the lamp, momentary power interruptions can cause the cathodes to cool and result in the high voltage ignition pulse failing to ignite the medium into the plasma, thereby eroding the cathodes. During operation of a lighted lamp, momentary interruptions in power can cause the lamp to become extinguished due to cooling of the cathodes.

In response to the lamp failing to start or becoming extinguished, some fluorescent lamp starters will immediately attempt to restart the lamp by heating the cathodes and generating high voltage ignition pulses. There are no restrictions on the number and frequency of attempts to restart the lamp. Consequently, frequent interruptions in the power supply voltage, or repeated unsuccessful attempts to light the lamp may result in overheating the ballast and premature failure of the lamp due to erosion of the thermionic coating on the cathodes.

It is with respect to these and other considerations that the present invention has evolved.

SUMMARY OF THE INVENTION

In general, the present invention is directed to controlling the operation of a fluorescent lamp to provide more reliable starting of the lamp, to avoid overheating a ballast and excessive erosion of the cathodes of the lamp and thereby to prevent premature failure of those components, and to allow the lamp to be controlled by short power interruptions in an effective manner.

In accordance with these and other aspects, the present invention includes a control module for use with a fluorescent lamp, and a control method, to control operation of the lamp in a circuit in which the lamp is connected to a ballast and energized by alternating half-cycles of power supplied from an AC power source. The fluorescent lamp has cathodes and a medium which emits light energy when energized into a plasma. The control module includes a controllable switch, a sensor and a transition state controller. The controllable switch is adapted to be connected to the cathodes. When the controllable switch is triggered into a conductive condition, it conducts half-cycles of AC current from the source through the cathodes. When the controllable switch is commutated into a non-conductive condition, it ceases conducting the AC current through the cathodes. The sensor is also adapted to be connected to the cathodes and to deliver at least one sensing signal related to an electrical condition at the cathodes. The state transition controller responds to the sensing signal and controls the switch to assume the conductive and non-conductive conditions. The state transition controller establishes a plurality of predetermined operational states and transitions between the states.

The operational states are a power-up state, a warm-up state, an ignition state and a fire state. The conditions under which transitions occur between these states to the electrical conditions sensed between the cathodes and the time duration of predetermined events. In the power-up state, the controllable switch is commutated into the non-conductive condition to prevent energization of the medium. In the warm-up state, the controllable switch is triggered into the conductive condition for a warm-up time period during which the current conducted through the cathodes to heat them. A transition from the power-up state to the warm-up state occurs at the conclusion of a stabilizing time period. The stabilizing time period allows operation of the state transition controller to stabilize. In the ignition state, the controllable switch is commutated into the non-conductive condition at a predetermined ignition point to create a di/dt effect that results in the ballast generating an ignition pulse to ionize the medium into a plasma. A transition from the warm-up state to the ignition state occurs after the warm-up time period. In the fire state, the controllable switch is commutated into the non-conductive condition to allow power from the source to sustain the plasma between the cathodes, or ignition pulses may be generated on a basis to increase the energy delivered to the fluorescent lamp to sustain its normal operation, as is described in some of the above-identified applications. A transition into the fire state from the ignition state occurs after the ignition time period.

Further, according to its preferred embodiments, the time duration of the stabilizing power-up, warm-up and ignition time periods are established. The occurrence and time duration of any momentary interruptions in power applied to the cathodes is determined, and the transitions from the states are governed by the occurrence and time duration of the momentary power interruptions. By distinguishing between the momentary power interruptions on the basis of time duration, certain types of momentary power interruptions may be used as input signals to establish and control the operational states of the lamp. The number of transitions from the fire state to the power-up state is counted to determine an overheating condition resulting from repeated attempts to light the lamp. After the occurrence of a predetermined number of such transitions, further attempts to light the lamp are terminated by maintaining the power-up state.

A more complete appreciation of the present invention and its scope can be obtained by reference to the accompanying drawings, which are briefly summarized below, the following detailed description of presently preferred embodiments of the invention, and the appended claims.

DETAILED DESCRIPTION

Figure 1:
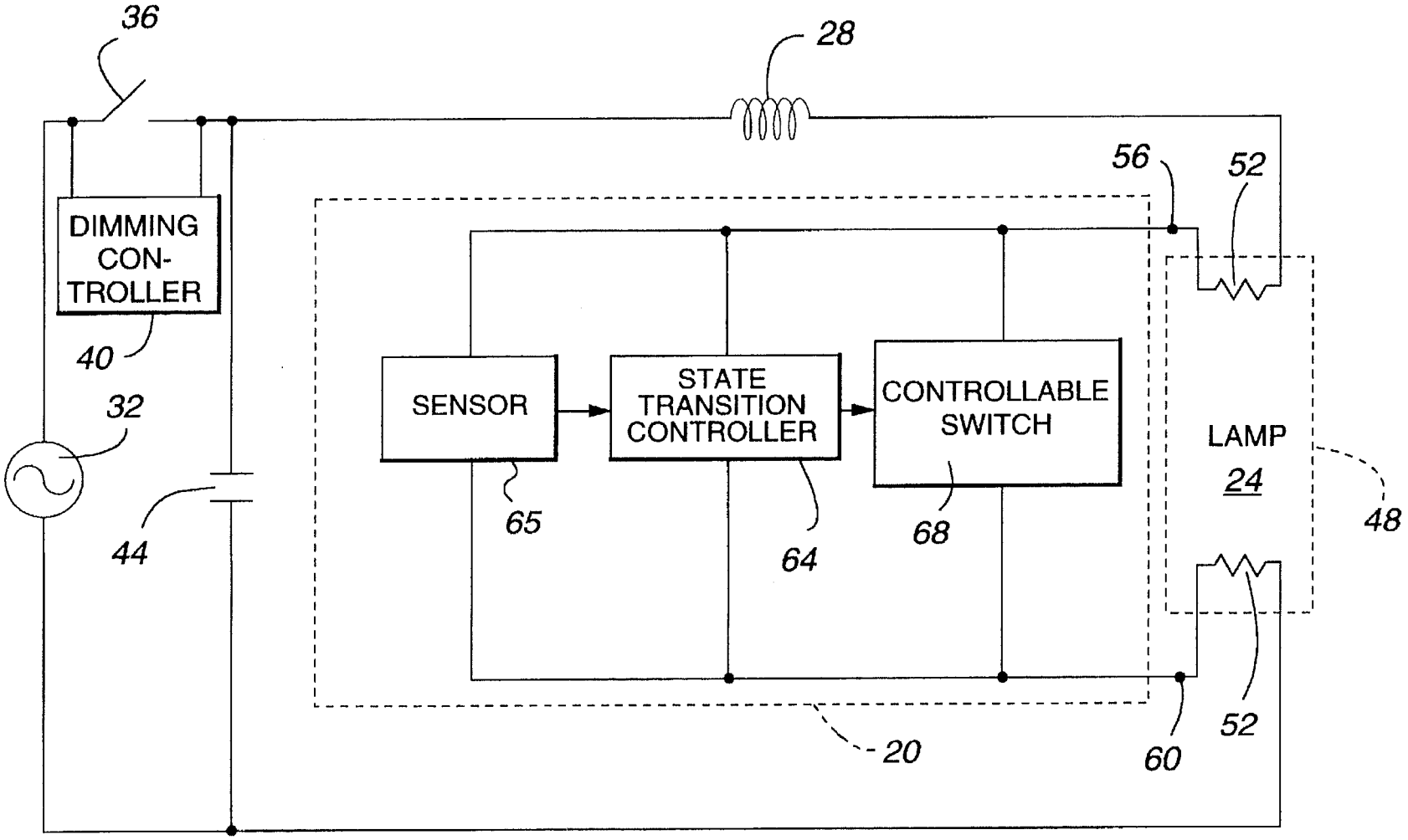
FIG. 1 is a simplified circuit diagram of a fluorescent lamp, a ballast, and an improved control module for the fluorescent lamp which incorporates the present invention, connected to a conventional AC power source and controlled by a manual switch or an dimming controller.

The features of the present invention are preferably embodied in a control module 20 shown in FIG. 1. The control module 20 is connected as a part of an otherwise-typical fluorescent lamp circuit 22, in which a fluorescent lamp 24 is connected in series with a conventional current limiting inductor known as a ballast 28. Conventional alternating current (AC) power from a source 32 is applied to the series connected lamp 24 and ballast 28 through a power control switch 36, or alternatively through an dimming controller 40. Typically the switch 36 will be a wall-mounted on/off power switch. The dimming controller 40 will replace, or be used as an alternative to the switch 36, and perform the on/off power control functions as well as dimming functions, as described in the concurrently filed patent application "Dimming Control System and Method for a Fluorescent Lamp" Ser. No. 08/616,541. A capacitor 44 may optionally be connected in parallel with the series connected ballast 28 and the fluorescent lamp 24 to establish a more favorable power factor when the dimming functions are utilized.

The fluorescent lamp 24 is formed in the conventional manner to include, generally, an evacuated translucent housing 48 which has two filament electrodes known as cathodes 52 located at opposite ends of the housing 48. A small amount of mercury is contained within the evacuated housing 48. When the lamp 24 is lighted, the mercury is vaporized and ionized, and a current is conducted between the cathodes 52 through the mercury medium to create a plasma. The light energy from the plasma creates the illumination. Due to the high conductivity, low resistance characteristics of the plasma medium, the ballast 28 is necessary to limit the current flow through the plasma to prevent the cathodes 52 from burning out.

The control module 20 is connected in series with and between the cathodes 52 at terminals 56 and 60. The control module 20 includes a state transition controller 64, a sensor 65 and a controllable switch 68. When triggered into a conductive condition, the controllable switch 68 connects the terminals 56 and 60 and conducts current through the cathodes 52. The controllable switch 68 ceases conducting current through the cathodes 52 when commutated into a non-conductive condition. The state transition controller 64 controls the triggering and commutation of the controllable switch 68 by functioning as a state machine to establish various operational states and to transition between those states under determined operational conditions. Some of those operational conditions are determined partially or wholly by electrical conditions sensed at the lamp cathodes 52 by the sensor 65.

Figure 2:
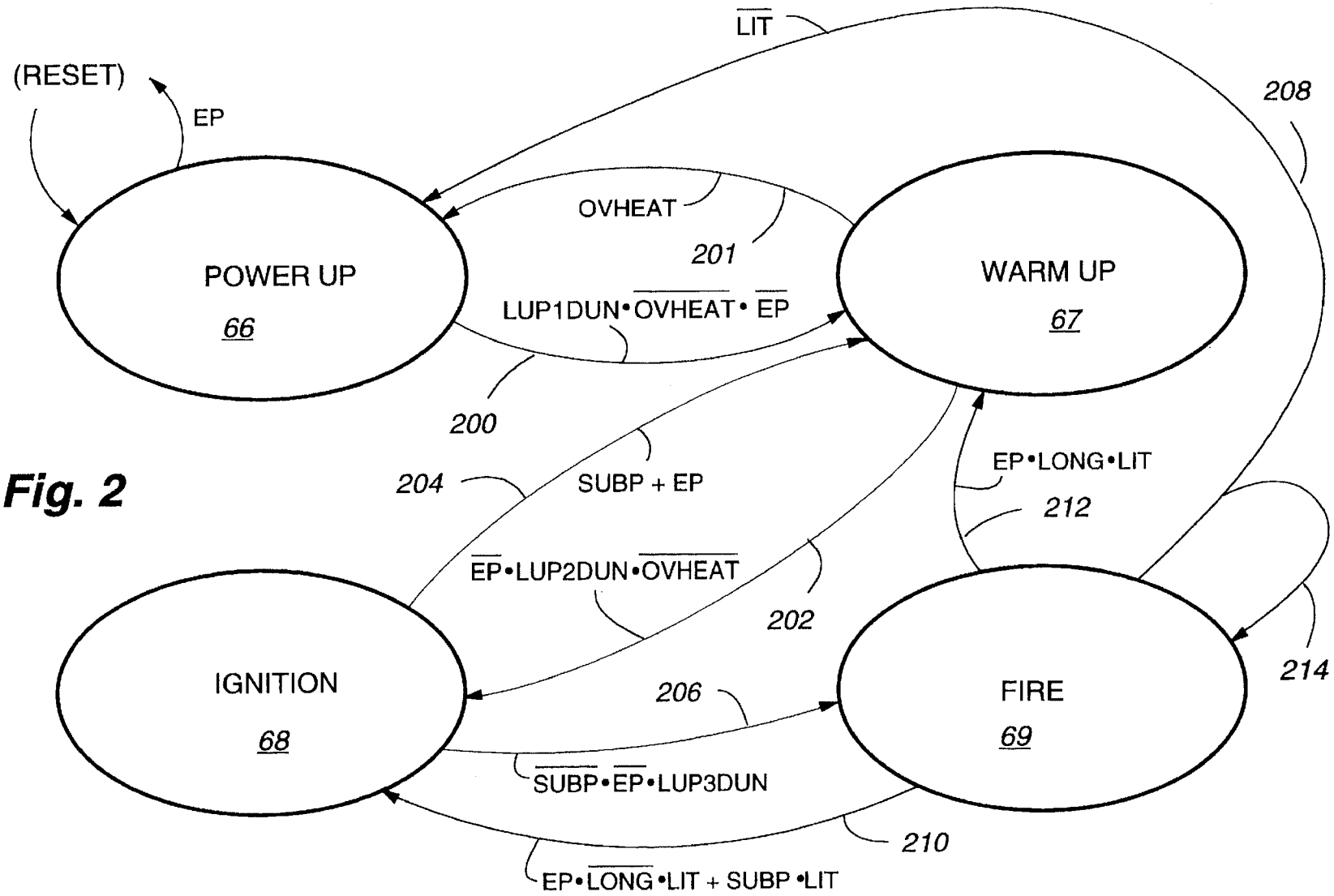
FIG. 2 is a state transition diagram showing operational states of a controller of the control module shown in FIG. 1 and the conditions which cause transitions between the operational states.

The operational states of the state transition controller 64 include a power-up state 66, a warm-up state 67, an ignition state 68, and a fire state 69, all of which are shown in greater detail in FIG. 2. The state transition controller 64 initializes in the power-up state 66 where the lamp is powered-off or idled. A transition 200 thereafter occurs to the warm-up state 67 where the lamp cathodes are warmed in preparation for ignition of the medium into a light-emitting plasma. A transition 202 to the ignition state 68 occurs after the lamp cathodes have been warmed. In the ignition state 68 the medium is ignited into the light-emitting plasma. Thereafter a transition 206 to the fire state 69 occurs, where the plasma is maintained in the ignited, light-emitting condition. As described below, the transitions between these states occur under timing conditions and in response to electrical conditions monitored by the sensor 65.

Figure 3:
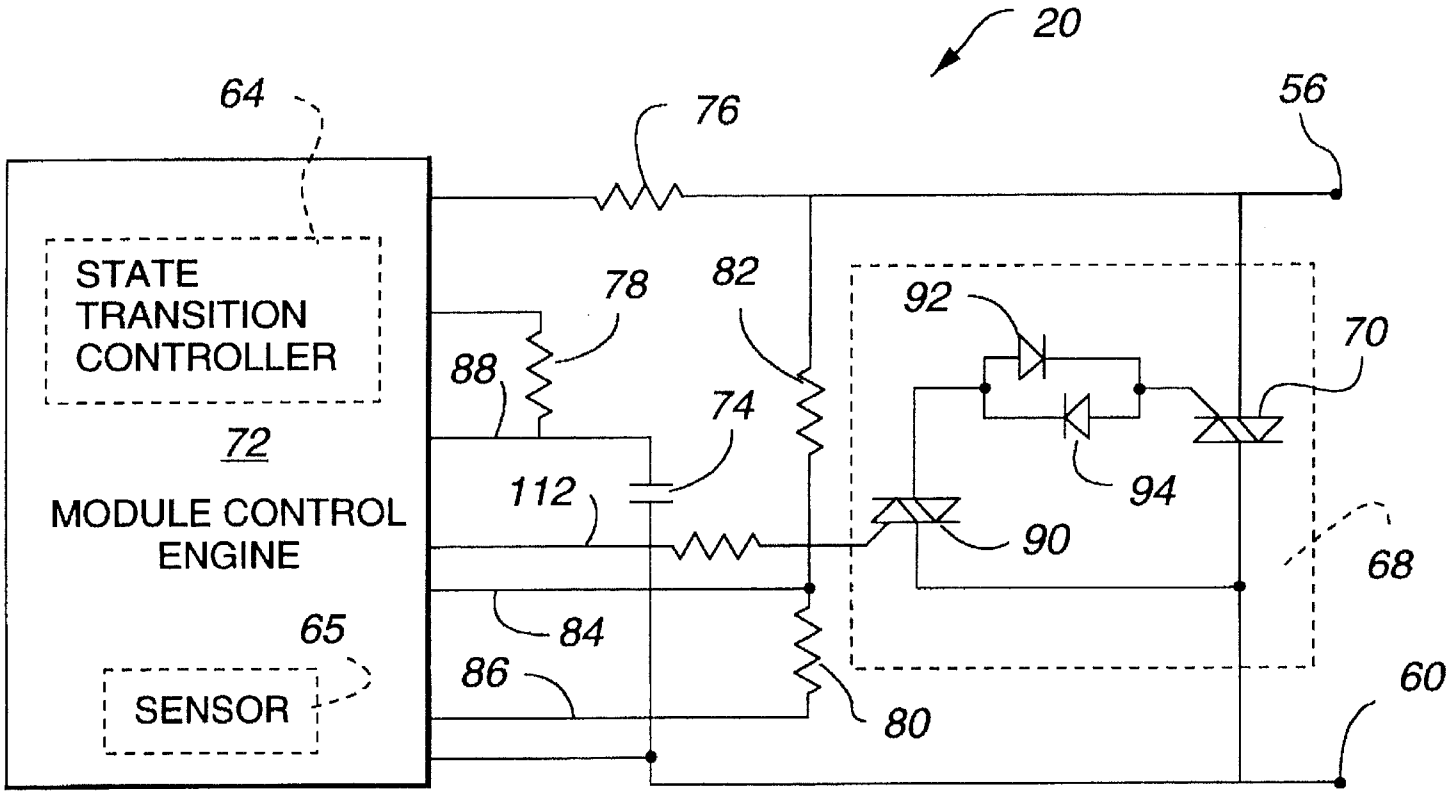
FIG. 3 is a schematic and block diagram of the control module shown in FIG. 1.

Details of a preferred embodiment of the control module 20 are shown in FIG. 3. The state transition controller 64 and the sensor 65 of the control module 20 are preferably subsumed or included within a module control engine 72. The engine 72 is preferably a single application specific integrated circuit which includes elements from a conventional microcontroller 72, microprocessor, programmed logic engine, or other similar device which has been programmed or set-up to function as a state machine. In addition the engine 72 additionally includes analog circuit elements to achieve the functions described below. The characteristics and capabilities of the module control engine 72 are apparent from the following description and from the descriptions of the functionality associated with the microcontrollers and other logic and analog circuit elements described in the above-identified applications. This state machine, e.g., engine 72, controls the conductive conditions of the controllable switch 68.

The controllable switch 68 preferably includes a high holding current thyristor 70, triac, SCR or other type of semiconductor current switching device which has the operational characteristics described herein and in the above-identified applications. A SCR with a variable holding current characteristic that has proved advantageous, and which allows the holding current value to be adjusted, is part number TN22 manufactured by SGS-Thompson Microelectronics.

The engine 72 is connected to the terminals 56 and 60, and as is shown in FIG. 1, the terminals 56 and 60 are adapted to be connected to the cathodes 52 of the lamp 24. When the lamp 24 is energized by AC power delivered by the power source 28, electrical power appears on the terminals 56 and 60. The AC power appearing on the terminals 56 and 60 charges a power storage capacitor 74 which is connected to the engine 72, as shown in FIG. 3. An internal rectifying circuit within the engine 72 causes the power storage capacitor 74 to charge to a DC power level, and to maintain that DC power for a sufficient time to sustain the operation of the engine 72 during momentary power interruptions. Upon the occurrence of longer power interruptions, the engine 72 ceases operation. A resistor 76 establishes the bias level of the voltage level on the storage capacitor 74. The signal supplied by resistor 76 to the engine 72 also indicates the polarity of the AC voltage appearing on terminals 56. This signal is used to distinguish between positive and negative AC half-cycles.

The engine 72 includes a conventional internal clock (not shown) which is used to establish the timing functions necessary to execute its programmed operational sequence. An externally connected resistor 78 establishes the frequency of the internal clock.

The sensor 65 is established in part by the functionality of the engine 72 and in part by a voltage divider formed by resistors 80 and 82. The resistors 80 and 82 sense the voltage between the terminals 56 and 60. Conductor 84 supplies a signal to the engine 72 from the voltage divider formed by the resistors 80 and 82. The signal on the conductor 84 is reduced in magnitude compared to the signal applied across the series-connected resistors 80 and 82, because resistor 82 has a value considerably greater than the value of resistor 80. The signal on conductor 84 is directly related to the voltage appearing across the lamp cathodes 52 (FIG. 1). Because the voltage across the lamp cathodes is an AC voltage, the relative magnitude of that voltage changes with each AC half-cycle.

To sense zero crossing points of the voltage applied to the cathodes, switches internal within the engine 72 alternately reference the signal 84 from the series-connected, voltage-dividing resistors 80 and 82 to conductors 86 and 88 with each succeeding AC voltage half-cycle, as determined by the signal from resistor 76. During a AC voltage half-cycle when the terminal 56 is positive with respect to terminal 60, the conductor 86 connected by an internal switch (not shown) to the conductor 88. The voltage on the conductor before is thereby referenced relative to the voltage across the storage capacitor 74. The magnitude of voltage under this circumstance is within the measuring capability of the engine 72 and within the value of voltage stored across the capacitor 74. In the opposite circumstance, however, when the next-succeeding AC voltage half-cycle causes terminal 56 to be negative with respect to terminal 60, an internal switch (not shown) connects the conductor 86 to the terminal 60. Again, the magnitude of the signal on the conductor 84 is within the measurement range of engine 72. The voltage reduction capability of the voltage divider, coupled with the alternate referencing capability described, provides a very precise technique for specifically identified zero voltage crossing points. Furthermore, the same technique is available to precisely measure the magnitude of the voltage appearing across the cathodes, as described below. Alternate voltage referencing is also described in U.S. patent application Ser. No. 530,673.

Power interruptions and zero crossing points of the AC voltage waveform are sensed as an absence of a voltage signal at 84. The time duration of the power interruptions and the other timing events described below are determined by the engine 72 by counting the cycles and half-cycles of the applied AC waveform occurring between zero crossing points, or by counting the clock signals which are generated internally by the engine based on the value of the resistor 78.

A trigger signal for firing or triggering the conductive switch 68 into a conductive condition is generated by the engine at 112. The thyristor 70 is a relatively high holding current device. The thyristor conducts current between the terminals 56 and 60 when triggered into a conductive state. Briefly, the holding current is that amount of current which the thyristor must conduct through its power terminals to maintain its conductive condition after it has been triggered. If the current falls below the holding current for any reason, the thyristor will immediately cease conduction by commutating into a non-conductive state.

Figure 4:
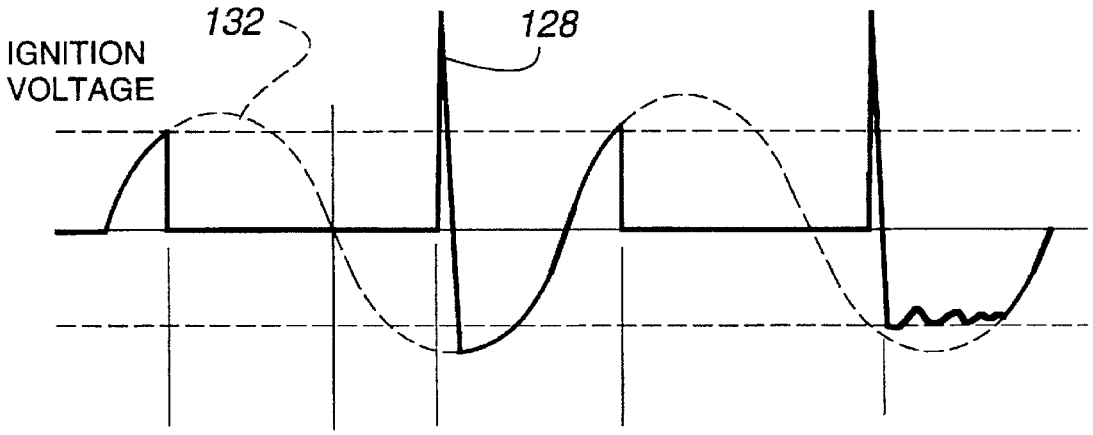
FIG. 4 is a waveform diagram of the voltage appearing across the fluorescent lamp when the controller shown in FIG. 1 is operating in the ignition state shown in FIG. 2.

The high holding current characteristic of the thyristor is advantageously used to reliably start or ignite the fluorescent lamp, as described in the above identified U.S. patent application Ser. No. 08/258,007, now U.S. Pat. No. 5,537,010. Briefly described here, however, when the current conducted from the AC source 32 decreases to the level of the holding current of the conductive thyristor 70 at the end of each half-cycle during starting of the lamp, the commutation of the thyristor 70 causes an almost instantaneous termination of the current flow through the control module 20. The commutation of the thyristor 70 occurs when the level of the applied AC current is at a sufficiently high value to result in a relatively high change in current in a relatively short amount of time (di/dt). The ballast 28 (FIG. 1) responds to the relatively high di/dt by producing a very high voltage ignition pulse 128 as shown in FIG. 4. The level of the AC voltage from the power source 32 (FIG. 1) is also shown as curve 132 in FIG. 1.

The voltage of the ignition pulse 128 is sufficiently high to break down the partially ionized mercury vapor medium within the lamp housing 48 and cause an arc to jump directly between the cathodes 52 (FIG. 1). The arc jumps directly between the cathodes 52 because the control module 20 is substantially non-conductive and no longer presents a current path between the lamp cathodes as a result of the non-conductive condition of the controllable switch 68 (FIG. 3). The arc between the lamp cathodes more completely ionizes the mercury medium into the light-emitting plasma, and thereafter the normal AC line voltage (132, FIG. 4), maintains the plasma in an energized, light-emitting state. This ignition sequence is more completely described in the above-identified patent applications.

Figure 5A:
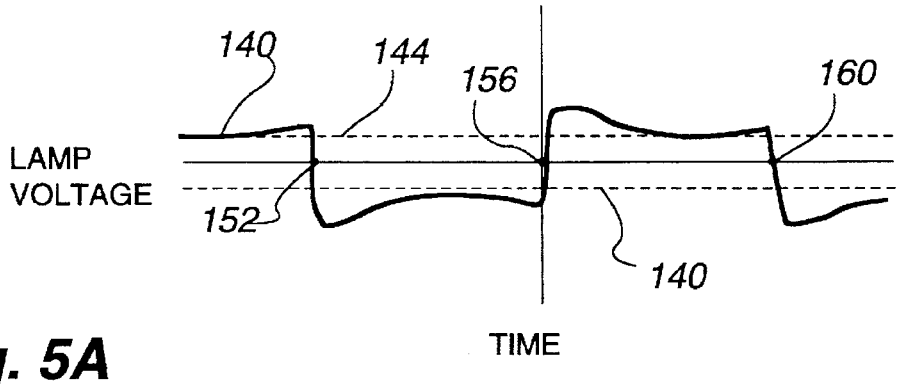
FIGS. 5A and 5B are waveform diagrams on a common time axis of the voltage appearing across the fluorescent lamp and of the current conducted through the ballast, respectively, when the controller shown in FIG. 1 is operating in the fire state shown in FIG. 2.

The ionization characteristics of the mercury plasma limit the voltage between the cathodes to a characteristic operating voltage which is represented by the curve 140 shown in FIG. 5A. The characteristic operating voltage 140 is essentially equal to the ionization voltage of mercury shown by curve 144 in FIG. 5A. The characteristic operating voltage of the fluorescent lamp varies by the composition of the mercury medium within the housing. Furthermore the characteristic operating voltage is adjusted depending on the voltage level of the applied AC power. For lamps used in conventional 120 volt AC applications, the characteristic operating voltage is usually in the neighborhood of 60 volts. For lamps used in 277 volt AC applications, the characteristic operating voltage is usually in the neighborhood of 125 volts.

Although the high holding current characteristic of the thyristor 70 is advantageously used to generate the high voltage ignition pulse 128, the high holding current characteristic of the thyristor 70 also makes it somewhat difficult to trigger the thyristor into a conductive condition. The ballast 28 (FIG. 1) limits the di/dt through the thyristor when the thyristor is initially triggered. A short trigger pulse 112 may initially trigger the thyristor 70, but if the current conducted through the thyristor 70 has not exceeded the holding current level when the trigger pulse 112 is terminated, the thyristor 70 will commutate to a nob-conductive state.

To avoid the problem of the thyristor 70 commutating off after being initially triggered and before the current has increased beyond the high holding current level, a sensitive gate thyristor 90 is used in conjunction with the high holding current thyristor 70, as shown in FIG. 3. The sensitive gate thyristor 90 is connected to the gate terminal of the thyristor 70 through a pair of parallel-connected, oppositely-polled diodes 92 and 94. The sensitive gate thyristor 90 has a relatively low holding current characteristic and is therefore triggered into the conductive state relatively rapidly because the current flow through it rapidly exceeds the holding current level. The thyristor 90 conducts current from the gate terminal of the thyristor 70. The current conducted from the gate of the thyristor 70 maintains the thyristor in a conductive state until the current through the thyristor 70 exceeds the holding current value. At the time that the current through the thyristor 70 exceeds its holding current value, the thyristor 70 becomes fully conductive, thereby diminishing the voltage across the thyristor 90 and causing thyristor 90 to commutate to the non-conductive state. When the current through the thyristor 70 diminishes below its holding current level, it commutates to the non-conductive state too.

To prevent a fixed holding current thyristor from generating the high voltage ignition pulse 128 (FIG. 4), as is described below during the warm-up state 67, the engine 72 may deliver a trigger signal 128 as the current through the thyristor 70 decreases to its holding current value. The thyristor 90 again becomes conductive, and its conductive characteristics prevent the generation of a di/dt effect. As the current diminishes to zero at the zero crossing point, the thyristor 90 is commutated to a non conductive state. No ignition pulse is generated under these conditions.

As an alternative to again triggering a fixed holding current thyristor at the end of a half-cycle during which the cathodes are warmed by current following through them, the use of a variable holding current thyristor (e.g., the TN22 SCR, mentioned above) avoids the necessity to trigger the thyristor a second time. The holding current may be increased or decreased by selectively varying the current delivered to the gate of the device. Thus, when a significant di/dt effect is desired, the gate current is modified to establish a high holding current, and when a diminished or no di/dt effect is desired, the gate current is also selectively modified to achieve a low holding current. As the current decreases near the end of the AC half-cycle during which the cathodes are heated, the holding current of the thyristor is decreased, thus avoiding the creation of a significant di/dt effect. The current which flows through the ballast 28 under normal conditions is shown in FIG. 5B by curve 148.

Figure 5B:
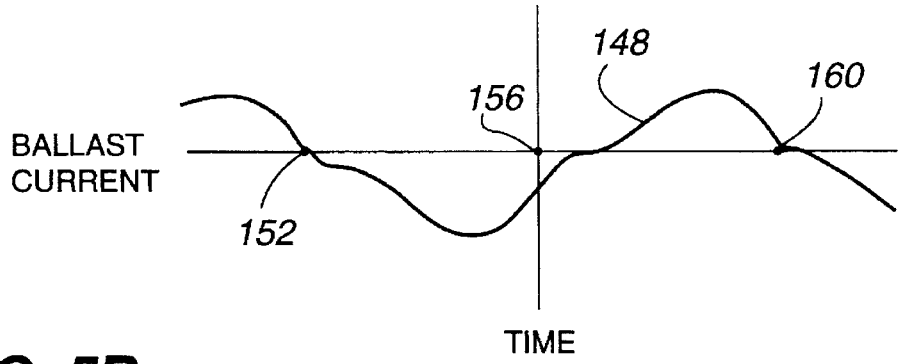

Points 152, 156 and 160 shown in FIGS. 5A and 5B represent the points where the applied AC voltage normally crosses the zero reference point represented by the horizontal axis in FIGS. 5A and 5B. The points 152, 156 and 160 thus represent the beginning and end of two consecutive half-cycles of applied AC voltage. The full illumination condition represented in FIG. 5A illustrates that the plasma is excited to the operating voltage 140 over almost the whole duration of each half-cycle, except for the relatively slight time intervals at the beginning and end of each half-cycle.

To determine the appropriate conditions for firing and commutating the thyristor, and to establish the states and the transitions between the states, the engine 72 senses various electrical conditions at the cathodes 52, connected to terminals 56 and 60, and also executes certain internal functions or routines, including timing and counting functions, among other things.

One internal function or routine performed by the engine 72 is a loop counting function. A conventional internal loop counter of the engine 72 is reset by a transition between states and is incremented for each applied AC voltage half-cycle or cycle that occurs during a state. The power-up, warm-up, and ignition states (FIG. 2) are maintained for at least a predetermined number of AC half-cycles or cycles (i.e., condition LUPDUN) before transitions are made from each of those states. As shown in FIG. 2 and in the following description, the appearance of a reference number in the term "LUPDUN" is an indication of a specific and different number of events counted by one or more loop counters. For example, "LUP2DUN" represents a different loop count value than "LUP3DUN."

Similarly, timing information associated with certain events is also determined by conventional aspects and features of the engine 72. The timing information may be obtained by reference to the frequency of the clock crystal 110, or by counting the cycles or half-cycles of the applied AC power waveform since the applied AC power waveform has a regularly-occurring, known, time interval.

Another function of the engine 72 is to sense interruptions in the supplied power. The occurrence of a power interruption is determined by a sensing signal derived at 84 as shown in FIG. 3. The duration of the sensing signal is timed to establish the time duration of the power interruption. The sensing signal delivered at 84 also is used to determine the magnitude of voltage existing across the lamp cathodes.

Power terminations or interruptions can result from sporadic power "glitches" in the delivery of power from the AC power source. Power interruptions can also be created by an operator using the switch 36 or the dimming controller 40 (FIG. 1) to generate control signals to be detected by the state transition controller 64 (FIG. 1) to accomplish lighting-control functions, such as changing the illumination intensity level of the lamp 24. The use of intentionally generated power interruptions to control lighting functions is described more completely in the concurrently filed U.S. patent application Ser. No. 08/616,541.

After determining the time duration of each power interruption, and based on the then-existing operational state and the program logic represented by the state transition diagram shown in FIG. 2, the engine 72 determines whether to execute a transition to a different operating state. A transition may be necessary or desirable to compensate for anticipated effects of cathode cooling during the power interruption, for example.

Preferably, each power interruption is classified according to one of four different types, depending upon the duration of the power interruption. The first type of power interruption is momentary and has a short duration, for example less than about two AC cycles. These first power interruptions are referred to herein as "SUBP." SUBP interruptions generally result from sporadic glitches in the power supplied. The second type of power interruption is also momentary and has a slightly longer duration, for example between about 3 and 6 AC cycles. The second type of power interruption is referred to herein as a "not-LONG" interruption. The "not-LONG" interruptions usually constitute input control signals supplied from the dimming controller 40 (FIG. 1) to the state transition controller 64. The third type of power interruption has a slightly longer time duration than the not-LONG power interruptions, for example about 7 or more AC cycles. The third type of power interruption is also momentary and is referred to herein as a "LONG" interruption. "LONG" power interruptions generally correspond to an operator manually actuating the switch 36 (FIG. 1) to generate input control signals to the state transition controller 64. The fourth type of power interruption is not normally regarded as momentary. The fourth type of power interruption is considerably longer in time duration than the LONG interruptions will result in termination of operation of the lamp and the control module 20, due to the termination of electrical power supplied.

Momentary power interruptions of the "not-LONG" and "LONG" types are extended in time to a sufficient degree that they typically cause cooling of the cathodes. These second and third types of power interruptions are collectively referred to herein as "EP" power interruptions.

Transitions between the operational states also occur to prevent overheating of the ballast 28 and/or the lamp cathodes 52 (FIG. 1). Overheating usually results from excess current conducted through the ballast and cathodes prior to attempting to ignite the lamp. While a few repetitive attempts to ignite the lamp will not heat the ballast excessively, the ballast will become overheated after some number of unsuccessful start attempts. The cathodes heat quickly and only a few unsuccessful start attempts can seriously erode the thermionic coating and thereby substantially reduce the lifetime of the lamp.

The engine prevents overheating of the cathodes and/or the ballast by counting the number of transitions from the warm-up state 67 to the ignition state 68 (FIG. 2) within a predetermined time. The overheating condition is referred to as "OVHEAT" in FIG. 2. Upon detecting an overheat condition ("OVHEAT"), a transition 201 to the power-up operational state 66 occurs. The engine remains in the power-up state 66 until it is reset by the user terminating the supply of power to the lamp 24 and control module 20 at the switch 36 (FIG. 1) or, alternatively, until at least a predetermined cool-off time period has elapsed to allow sufficient cooling.

The transitions between operational states are based on the logical relationship of certain conditions, as described below. The logical relationship of these conditions is shown in FIG. 2 by the use of a "+" to indicate an "or" logical relationship between the conditions and using "·" to indicate an "and" logical relationship between conditions.

As shown in FIG. 2, the engine initially enters the power-up state 66 in response to being reset by the initial application of AC power through the switch 36 or the controller 40 (FIG. 1). The power-up state 66 idles the lamp during periods of instability, such while the engine initializes after being reset or after overheating condition has been determined. In the power-up state 66, the controllable switch 68 (FIG. 3) is commutated into a non-conductive condition to prevent current from flowing through the cathodes. The power-up state 66 can be entered as a result of an extended power interruption (EP) which resets the engine.

A transition from the power-up state 66 to the warm-up state 67 occurs when the following three conditions have all been satisfied: (1) a predetermined number of AC cycles (e.g., about 8 half-cycles) have been counted by the loop counter of the engine 72 (i.e., condition LUP1DUN); (2) the controller has not sensed an overheat condition (i.e., condition not-OVHEAT); and (3) no extended power interruption has occurred (i.e., condition not-EP). Satisfying these three conditions indicates an operating stability of the engine and a suitable basis for a transition to the other operating states.

A transition from the power-up state 66 to the warm-up state 67 is shown at 200. If a power interruption occurs during the then-occurring AC half-cycle, the transition 200 occurs during the AC half-cycle following the end of the power interruption so long as the three conditions remain satisfied. Requiring that these three conditions be satisfied before transitioning to the warm-up state 67 avoids periods of instability in lamp operation, erratic lamp operation resulting from interruptions in the supplied power, and continued lamp starting operations after multiple failures to light the lamp (i.e., condition not OVHEAT).

In the warm-up state 67, the cathodes are warmed in preparation for ignition of the medium into the plasma. The engine 72 triggers the controllable switch 68 (FIG. 3) into conduction to establish a series circuit with the power source through the cathodes for a predetermined warm-up time period determined by the engine. During the warm-up time period, AC current from the source 32 flows through both cathodes 52 (FIG. 1), thereby heating the cathodes. The heat from the cathodes 52 helps vaporize the mercury within the housing 48. The heated cathodes 52 also emit low work energy ions from a barium coating on the surface of the cathodes to assist further in establishing an ionized environment within the housing 48.

To prevent the generation of an ignition pulse 128 (FIG. 4) as the current decreases when nearing the zero crossing point of the AC half-cycle when the cathodes are being warmed in the warm-up state 67, the controllable switch 68 may be triggered again at the conclusion of the half-cycle, as described above. Triggering the controllable switch 68 prevents the di/dt from occurring, because the controllable switch is in a conductive condition as the current passes through the holding current level, thereby preventing the generation of the di/dt effect. This feature is more completely described in the above-identified U.S. patent application Ser. No. 08/530,673.

A transition 202 is made from the warm-up state 67 to the ignition state 68 when the following three conditions have all been satisfied: (1) a predetermined number of AC cycles (e.g., about 64 half-cycles) have been counted by the loop counter since entering the warm-up state 67 (i.e., condition LUP2DUN); (2) an overheat condition has not been sensed (i.e., condition not-OVHEAT); and (3) no extended power interruption has occurred (i.e., condition not-EP). The predetermined number of cycles or half-cycles represented by LUP2DUN establishes the determined warm-up time period for the cathodes. The occurrence of an overheat condition (OVHEAT) or a cathode cooling condition from an extended power interruption (EP) will prevent the transition 202 from occurring from the warm-up state 67. A transition 201 from the warm-up state 67 back to the power-up state 66 occurs when an overheating condition of the cathodes has been determined (i.e., condition OVHEAT). An extended power interruption (EP) causes the operational state to remain in the warm-up state 67 until the cathodes are sufficiently heated, at which point the conditions for the transition 202 are satisfied.

Transitioning at 202 only when the three conditions have been satisfied advantageously avoids the problems associated with attempting ignition when the cathodes have been insufficiently heated, or when a power interruption has occurred, or if an overheat condition exists. Consequently, repeated attempts to ignite the lamp are prevented under unfavorable conditions, and repeated attempts to ignite the lamp are allowed only when conditions exist that are conducive to long lamp and ballast life.

After a transition 202 to the ignition state 68, the high voltage ignition pulses 128 (FIG. 4) are generated. Under normal conditions, the lamp will light in response to these high voltage ignition pulses.

If any type of power interruption other than a long power interruption (i.e. conditions SUBP or EP) is detected in the ignition state 68, a transition will occur at 204 from the ignition state 68 back to the warm-up state 67 to reheat the lamp cathodes. In this manner, the cooling effect from the power interruption is overcome by again warming the cathodes prior to again attempting to ignite the lamp. The continual application of high voltage ignition pulses to the cooled cathodes is avoided. Warming the cathodes in the warm-up state 67 after any power interruption other than a very long power interruption while in the ignition state 68 improves the likelihood that the subsequent transition 202 to the ignition state 68 will result in the successful ignition of the lamp.

The transition at 206 from the ignition state 68 to the fire state 69 occurs when the loop counter has counted a predetermined number of AC cycles (e.g., 10 half-cycles) after the beginning of the ignition state 68 (i.e., condition LUP3DUN), provided that no power interruption is sensed (i.e., the not-SUBP and not-EP conditions). The time period in the ignition state 68, determined by the LUP3DUN count value (e.g., 10 AC half-cycles), is generally sufficient to ignite the plasma. The length of time is not so excessive as to create unacceptable erosion of the cathodes due to the high voltage of the ignition pulse.

In the fire state 69, the controllable switch 68 (FIG. 3) is maintained in a non-conductive state, allowing the AC voltage from the power supply 32 to be applied directly to the cathodes and thereby maintain the plasma in the ignited state. However, in the case of the inventions described in the above-identified U.S. patent applications Ser. Nos. 08/531,037 and 08/530,563, the controllable switch 68 (FIG. 3) may occasionally be switched to add energy to sustain the lamp in a lighted condition. This functionality is represented by the loop 214, signifying that a transition does not occur from the fire state while the extra added energy is supplied to maintain the lamp in a lighted condition.

To determine if the lamp is ignited or extinguished during the fire state 69, the engine performs a lamp check operation at approximately the midpoint of each applied AC half-cycle. If extinguished, the lamp needs to be re-ignited. If the lamp is lighted, the condition is as expected. To perform a lamp check, the engine sets a conventional internal timer at each zero-crossing of the applied AC half-cycle, e.g., points 152, 156 and 160 shown in FIGS. 5A and 5B. The set count value causes the internal timer to time out at a time midway through the applied AC voltage half-cycle. At this mid half-cycle time, the voltage of the sine wave of the applied AC voltage (132, FIG. 4) is at or near its peak. The voltage across the cathodes is measured by sensing the signal 84 (FIG. 3) at this midpoint time.

If the measured voltage across the cathodes 52 exceeds the characteristic operating voltage (140, FIG. 5A), the lamp is extinguished and needs to be re-ignited. If the lamp is ignited at the lamp check time, the voltage across the lamp cathodes is only at the characteristic operating voltage level 140, not the higher level of the peak of the impressed AC voltage. A sensed voltage at or near the characteristic operating voltage of the plasma indicates that the lamp is lighted. The condition "LIT" shown in FIG. 2 represents the determination that the lamp is lighted. A sensed voltage at or near the peak of the impressed AC voltage indicates that the plasma is extinguished because the full voltage of the applied AC power is impressed on the cathodes, not through a conductive plasma.

In response to the engine determining that the lamp has become extinguished (i.e., the not-LIT condition), a transition 208 is made to the power-up state 66 to begin the sequence just described for restarting the lamp. The number of transitions 208 from the fire state 69 to the power-up state 66 are measured over a predetermined time period to determine whether an overheat condition (OVHEAT) has occurred. In response to sensing an overheat condition ("OVHEAT"), the engine remains in the power-up state 66 to prevent further attempts to light the lamp.

A transition 210 from the fire state 69 to the ignition state 68 occurs to re-ignite the lamp after a power interruption of a sufficiently short duration such that the lamp can be reignited without first reheating the cathodes. This functionality allows for short power interruptions without re-warming the lamp before re-ignition. The conditions under which the transition at 210 occurs are sensing the completion of an extended power interruption (EP) that was not-LONG while the lamp was lighted (LIT), (i.e., a logical "and" combination of the conditions EP, not-LONG, and LIT); or sensing a power interruption having a duration less than about two AC cycles (SUBP) while the lamp was lighted (LIT) (i.e., a logical "and" combination of conditions SUBP and LIT). The transition 210 thus allows the short power interruptions to have a control effect on the operation of the lamp and to ignite the lamp immediately thereafter without the necessity to reheat the cathodes.

As a consequence of the definition of an EP power interruption, an EP power interruption which is not-LONG is a power interruption of the second type referred to above. This type of power interruption is generally created by the dimming controller 40 (FIG. 1). The first SUBP type of power interruption is very short, and will typically result from a power supply glitch. Thus, the transition 210 allows the lamp to be immediately ignited without warming the cathodes with the first and second types of momentary power interruptions occur. This ability to re-light the lamp immediately is particularly important when the dimming controller is employed, because of the almost instantaneously-perceived control over the lighting control functions of the lamp.

An occurrence of the longer, third type of momentary power interruption, a LONG interruption, will require the cathodes to be reheated before an ignition attempt can be made. A transition at 212 from the fire state 69 to the warm-up state 67 occurs after a LONG power interruption as occurred. The conditions which give rise to the transition 212 are the occurrence of an extended power interruption (EP) that was LONG while the lamp was lighted (LIT) (i.e., a logical combination of conditions EP, LONG, and LIT). Without reheating the cathodes after a LONG power interruption, an attempt at igniting the lamp medium into the plasma without preheating the cathodes is very likely to cause excessive cathode erosion.

As can be appreciated from preceding discussion, the state transition controller establishes a plurality of predetermined operational states that include a power-up state, a warm-up state, an ignition state, and a fire state. The transitions between the states are established in response to electrical and timing conditions that exist or are sensed at the cathodes of the fluorescent lamp. The states and associated transitions provide more reliable starting of the lamp in response to momentary power interruptions of various lengths, avoid overheating of the ballast or lamp cathodes to thereby prevent premature failure of those components, and allow the lamp to be effectively controlled by short power interruptions without necessarily completing a complete ignition sequence. Many other important advantages and features will be apparent after completely appreciating the significance of the invention.

A presently preferred embodiment of the invention and its improvements have been described with a degree of particularity. This description has been made by way of preferred example. It should be understood that the scope of the present invention is defined by the following claims, and should not necessarily be limited by the detailed description of the preferred embodiment set forth above.

The invention claimed is:

1. A control module for use with a fluorescent lamp to control operation of the lamp in a circuit in which the lamp is connected to a ballast and energized by alternating half-cycles of power supplied from an AC power source, the fluorescent lamp having cathodes and a medium which emits light energy when energized into a plasma, said control module comprising:

a controllable switch adapted to be connected to the cathodes and triggerable into a conductive condition to conduct half-cycles of AC current from the source through the cathodes and commutatable into a non-conductive condition to cease conducting the AC current through the cathodes;

a sensor adapted to be connected to the cathodes and to deliver at least one sensing signal related to at least one predetermined electrical condition at the cathodes; and a state transition controller receptive of the sensing signal and connected to the controllable switch for controlling the controllable switch to assume the conductive and non-conductive conditions, the state transition controller establishing a plurality of predetermined operational states and transitioning between the states in response to conditions including the sensing signal and time conditions, the operational states and the transitions including:

a power-up state during which the controllable switch is commutated into the non-conductive condition to prevent energization of the medium;

a warm-up state during which the controllable switch is triggered into the conductive condition for a warm-up time period during which the current conducted by the controllable switch heats the cathodes;

a transition from the power-up state to the warm-up state occurring at the conclusion of a stabilizing time period after the power-up state is first entered, the stabilizing time period allowing operation of the state transition controller to stabilize before transitions occur and other states are established;

an ignition state during which the controllable switch is commutated into the non-conductive condition at a predetermined ignition point during at least one of a plurality of half-cycles of AC power conducted from the source by the controllable switch through the cathodes during an ignition time period, the commutation of the controllable switch into the non-conductive condition creating a di/dt effect which causes the ballast to generate an ignition pulse to ionize the medium into a plasma;

a transition from the warm-up state to the ignition state occurring at the conclusion of the warm-up time period;

a fire state in which the controllable switch is commutated into the non-conductive condition to allow power from the source to sustain the plasma between the cathodes; and a transition into the fire state from the ignition state occurring after the conclusion of the ignition time period.

2. A control module as defined in claim 1 wherein:

the state transition controller counts half-cycles of power applied to the cathodes; and the predetermined stabilizing time period, the warm-up time period and the predetermined ignition time period are each defined by a predetermined plurality of half-cycles counted by the state transition controller.

3. A control module as defined in claim 2 wherein:

the number of half-cycles counted to define the stabilizing time period, the warm-up time period and the ignition time period is different for each time period.

4. A control module as defined in claim 1 wherein:

the state transition controller utilizes the sensing signal to determine the occurrence and time duration of any momentary interruptions in power applied to the cathodes; and the transitions from the power-up state to the warm-up state and from the warm-up state to the ignition state each can occur in the presence of a momentary power interruption occurring during the state from which the transition occurs only if the momentary power interruption has a time duration less than a first predetermined time.

5. A control module as defined in claim 4 wherein:

the transition from the ignition state to the fire state does not occur if a momentary power interruption occurs during the ignition state.

6. A control module as defined in claim 4 wherein:

a transition from the ignition state to the warm-up state occurs after sensing a momentary power interruption while in the ignition state.

7. A control module as defined in claim 4 wherein:

a transition from the fire state to the warm-up state occurs if a momentary power interruption occurs during the fire state and the time duration of the momentary power interruption indicates that the cathodes have cooled sufficiently during the power interruption to significantly increase erosion of the cathodes upon application of the ignition pulse.

8. A control module as defined in claim 4 wherein:

a transition from the fire state to the ignition state occurs if a momentary power interruption occurs during the fire state and the time duration of the momentary power interruption indicates that the cathodes have maintained a temperature during the momentary power interruption which will not require heating during the warm-up state to avoid significant erosion upon application of an ignition pulse.

9. A control module as defined in claim 4 wherein:

the state transition controller responds to input control signals in the form of momentary power interruptions of a second determined time duration which is greater than the first predetermined time.

10. A control module as defined in claim 9 wherein:

a transition from the ignition state to the warm-up state occurs after sensing a momentary power interruption of the first or second predetermined time while in the ignition state.

11. A control module as defined in claim 9 wherein:

the state transition controller further responds to input control signals in the form of momentary power interruptions of a third determined time duration which is greater than the second predetermined time;

a transition from the fire state to the ignition state occurs after sensing a momentary power interruption of the first or second predetermined time while in the fire state; and a transition from the fire state to the warm-up state occurs when the time duration of a momentary power interruption is of a third predetermined time duration indicative of sufficient cooling of the cathodes to significantly increase erosion of the cathodes upon application of the ignition pulse.

12. A control module as defined in claim 1 wherein:

the state transition controller determines the magnitude of voltage between the cathodes at a predetermined point during at least one half-cycle of AC voltage while in the fire state and compares determined voltage to a predetermined characteristic operating voltage of the plasma to determine if the lamp is lighted.

13. A control module as defined in claim 12 wherein:

a transition from the fire state to the power-up state occurs when it is determined that the lamp is not lighted while in the fire state.

14. A control module as defined in claim 13 wherein:

the state transition controller counts the number of transitions from the fire state to the power-up state and determines an overheating condition after the occurrence of a predetermined number of transitions from the fire state to the power-up state within a predetermined time period.

15. A control module as defined in claim 14 wherein:

the power-up state is maintained without transitions from the power-up state for at least a predetermined time duration after determining an overheating condition.

16. A control module as defined in claim 14 wherein:

the power-up state is maintained without transitions from the power-up state until the state transition controller is reset after the determination of an overheating condition.

17. A method of establishing a plurality of predetermined operational states and transitioning between the states to control lighting conditions of a fluorescent lamp connected in a circuit with a ballast and energized by half-cycles of AC current and AC voltage from an AC power source, the fluorescent lamp having cathodes and a medium which is energized into a plasma which emits light energy, said method comprising the steps of:

establishing a power-up state in which the conduction of AC current from the power source through the cathodes is prevented for a stabilizing time period;

establishing a warm-up state in which the conduction of AC current from the power source through the cathodes occurs for a warm-up time period sufficient to heat the cathodes for reliable ignition of the lamp;

transitioning from the warm-up state to the power-up state at the conclusion of the stabilizing time period beginning after the power-up state is first entered;

establishing an ignition state in which the conduction of AC current from the power source through the cathodes is terminated at a predetermined ignition point during at least one of a plurality of half-cycles of current conducted from the source through the cathodes during an ignition time period;

transitioning from the warm-up state to the ignition state at the conclusion of the warm-up time period;

generating an ignition pulse of voltage to ionize the medium into a plasma from a di/dt effect of the ballast caused by the termination of current flow through the cathodes during the ignition state;

establishing a fire state during which AC voltage from the AC power source is applied to the cathodes to maintain the plasma between the cathodes; and transitioning into the fire state from the ignition state after the conclusion of the ignition time period.

18. A method as defined in claim 17 further comprising the steps of:

predetermining the time length of the stabilizing time period, the warm-up time period and the ignition time period;

counting half-cycles of power applied from the source to the cathodes; and establishing the time length of the stabilizing time period, the warm-up time period and the ignition time period from the number of half-cycles counted while in each state.

19. A method as defined in claim 17 further comprising the steps of:

sensing any momentary interruption in the AC power supplied to the cathodes;

determining the time duration of the sensed momentary power interruption;

transitioning from the power-up state to the warm-up state and from the warm-up state to the ignition state only if a momentary power interruption of a time duration less than a first predetermined time occurs while in the state from which the transition occurs; and transitioning from the ignition state to the fire state only in the absence of any momentary power interruptions.

20. A method as defined in claim 19 further comprising the steps of:

determining the magnitude of the voltage between the cathodes at a predetermined point during at least one half-cycle of AC voltage applied to the cathodes during the fire state;

comparing the determined voltage to a predetermined operating voltage of the plasma to determine if the lamp is lighted, a lighted lamp being indicated by a determined voltage approximately equal to the characteristic operating voltage and an extinguished lamp being indicated by a determined voltage greater than the characteristic operating voltage;

controlling the lighting conditions of the lamp by creating input control signals in the form of momentary power interruptions of a second determined time duration which is greater than the first predetermined time;

transitioning from the fire state to the power-up state when the lamp is determined to be extinguished during the fire state;

transitioning from the fire state to the warm-up state when the lamp is determined to be lighted and upon the occurrence of a momentary power interruption of a third predetermined time duration which is greater than the second time duration; and transitioning from the fire state to the ignition state when the lamp is determined to be lighted and upon the occurrence of a momentary power interruption of the first or second time durations.

21. The method as defined in claim 20 further comprising the steps of:

counting transitions between the fire state and the power-up state;

determining the existence of an overheating condition when the counted transitions from the fire state to the power state exceed a predetermined number; and maintaining the power-up state without transitioning therefrom for at least a predetermined period of time in response to determining an overheating condition.

* * * * *